US009267758B2

(12) United States Patent
Risicato

(10) Patent No.: US 9,267,758 B2
(45) Date of Patent: Feb. 23, 2016

(54) POINTER ILLUMINATOR DEVICE FOR AUTONOMOUS USE AND WITH A TOY WEAPON

(76) Inventor: Roberto Risicato, Paderno Dugnano (IT)

( * ) Notice: Subject to any disclaimer, the term of this patent is extended or adjusted under 35 U.S.C. 154(b) by 537 days.

(21) Appl. No.: 13/541,129

(22) Filed: Jul. 3, 2012

(65) Prior Publication Data

US 2013/0014736 A1 Jan. 17, 2013

(30) Foreign Application Priority Data

Jul. 5, 2011 (IT) ..... TO2011A0591

(51) Int. Cl.

| | |
|---|---|
| ***F41G 1/00*** | (2006.01) |
| ***F41C 23/16*** | (2006.01) |
| ***F41G 1/35*** | (2006.01) |
| *F21S 9/02* | (2006.01) |
| *F21W 111/10* | (2006.01) |
| *F21Y 101/02* | (2006.01) |
| *F41G 3/14* | (2006.01) |

(52) U.S. Cl.

CPC . *F41C 23/16* (2013.01); *F41G 1/35* (2013.01); *F21S 9/02* (2013.01); *F21W 2111/10* (2013.01); *F21Y 2101/025* (2013.01); *F41G 3/145* (2013.01)

(58) Field of Classification Search

CPC ..... F41A 11/00; F41A 11/02; F41A 11/04; F41A 11/06; F41A 33/02; F21A 21/48; F21A 21/481; F21A 21/482; F41C 33/0254; F41G 1/34; F41G 1/35; F41G 1/00; F41G 1/001; F41G 1/003; F41G 3/14; F41G 3/145; F41G 3/2616; F41G 3/2655

USPC ..... 362/109–110, 113, 114, 190–191, 259, 362/553–556; 42/1.01, 111, 113, 114, 116, 42/121, 123, 131, 133, 134, 146, 72, 42/75.01–75.03; 124/80

See application file for complete search history.

(56) References Cited

U.S. PATENT DOCUMENTS

| | | | | |
|---|---|---|---|---|
| 5,179,235 | A | 1/1993 | Toole | |
| 5,622,000 | A | 4/1997 | Marlowe | |
| 6,622,416 | B2 * | 9/2003 | Kim | 42/146 |
| 7,559,167 | B1 * | 7/2009 | Moody et al. | 42/72 |
| 7,866,083 | B2 * | 1/2011 | Teetzel | 42/146 |

(Continued)

FOREIGN PATENT DOCUMENTS

| | | |
|---|---|---|
| WO | 2005/047801 A1 | 5/2005 |
| WO | 2007/012571 A1 | 2/2007 |

*Primary Examiner* — Evan Dzierzynski
*Assistant Examiner* — Zheng Song
(74) *Attorney, Agent, or Firm* — Jason D. Voight

(57) ABSTRACT

A pointer illuminator device for autonomous use and with a toy weapon, having means for producing an incoherent light for illumination and at least one laser unit for producing a laser marking light, characterized in that it has: a light emission unit; a control and supply unit structurally separate from the light emission unit; and electric circuit connection means of supply, control and push button means of the control and supply unit relative to lighting means, indicator means and coherent light emission or laser marker means of the light emission unit. Moreover, the device has detachable mechanical connections of certain parts such that said same device can be used selectively in combination with the toy weapon and as an autonomous and portable entity with handgrip, for pointing of the same toy weapon, for lighting and/or as indicator light.

12 Claims, 11 Drawing Sheets

(56) References Cited

U.S. PATENT DOCUMENTS

| | | | | |
|---|---|---|---|---|
| 7,954,273 | B1 * | 6/2011 | Swan | 42/115 |
| 8,220,946 | B1 * | 7/2012 | Teetzel | 362/110 |
| 2008/0205037 | A1 * | 8/2008 | Griffin | 362/110 |
| 2009/0013581 | A1 * | 1/2009 | LoRocco | 42/132 |
| 2009/0044439 | A1 * | 2/2009 | Phillips et al. | 42/72 |
| 2009/0140015 | A1 * | 6/2009 | Faifer | 224/191 |
| 2009/0178325 | A1 | 7/2009 | Veilleux | |
| 2009/0260270 | A1 * | 10/2009 | Wu | 42/133 |
| 2011/0010981 | A1 * | 1/2011 | Wieland | 42/114 |
| 2011/0047850 | A1 * | 3/2011 | Rievley et al. | 42/72 |
| 2011/0074303 | A1 * | 3/2011 | Stokes | 315/250 |

* cited by examiner

FIG. 5
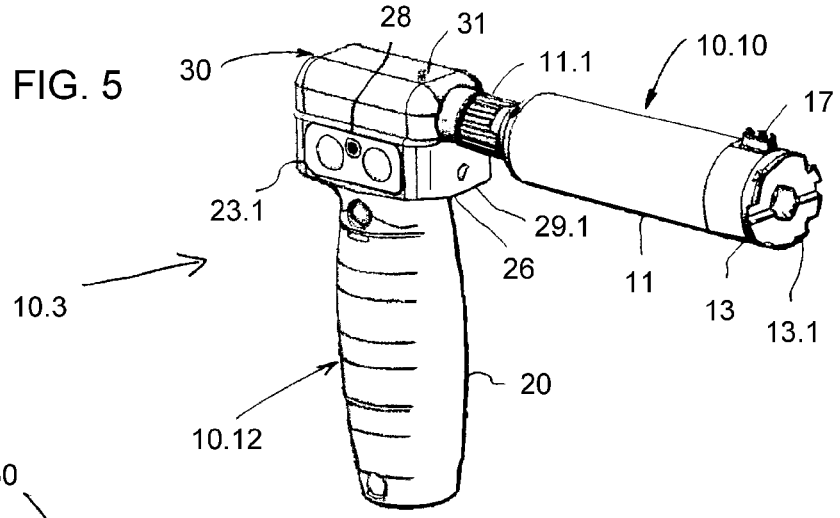
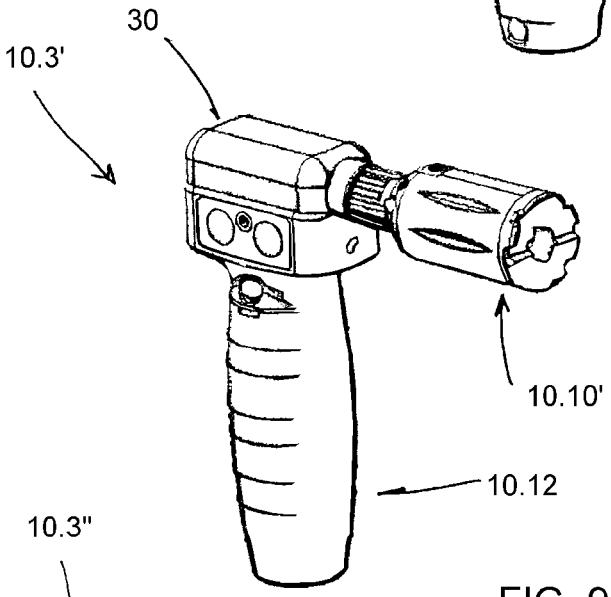
FIG. 9
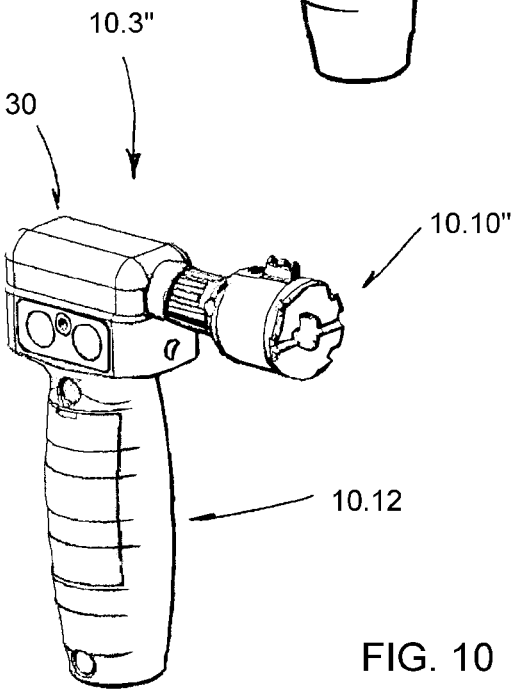
FIG. 10

FIG. 6
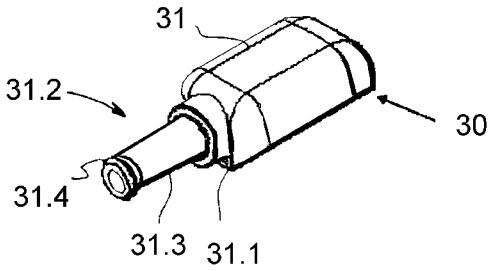
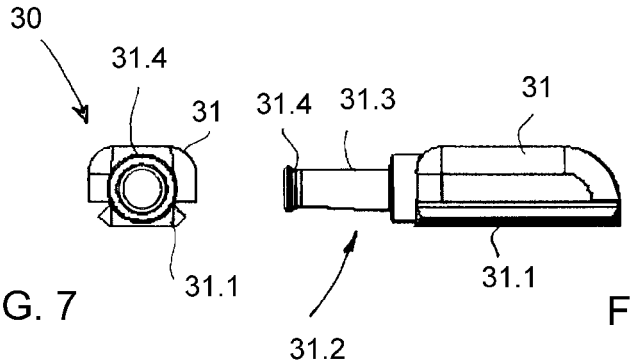
FIG. 7
FIG. 8

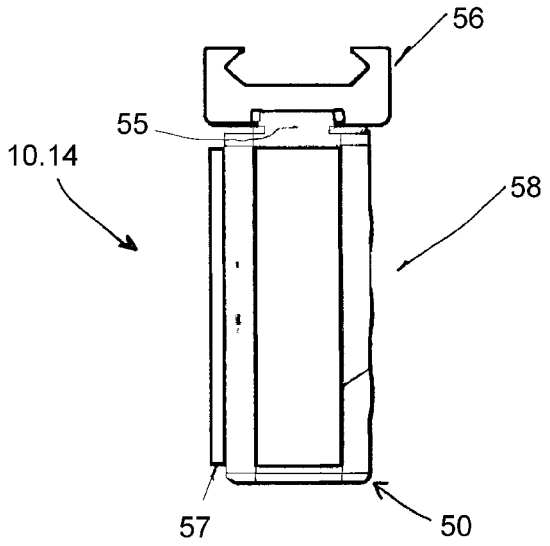
FIG. 22
FIG. 23
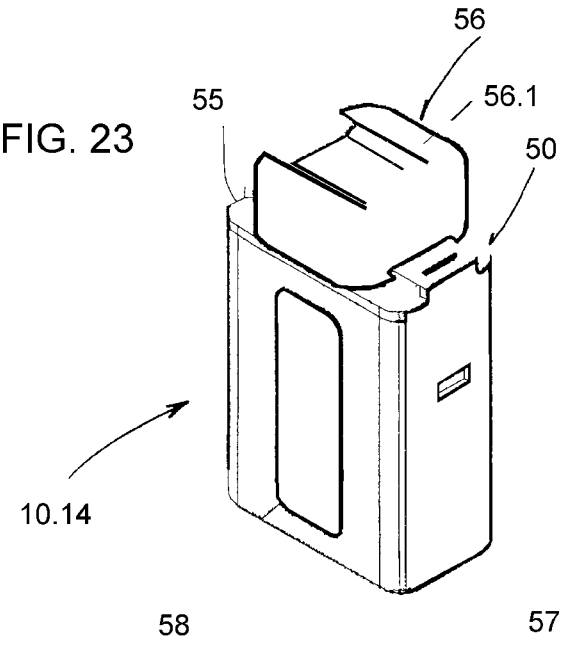
FIG.24
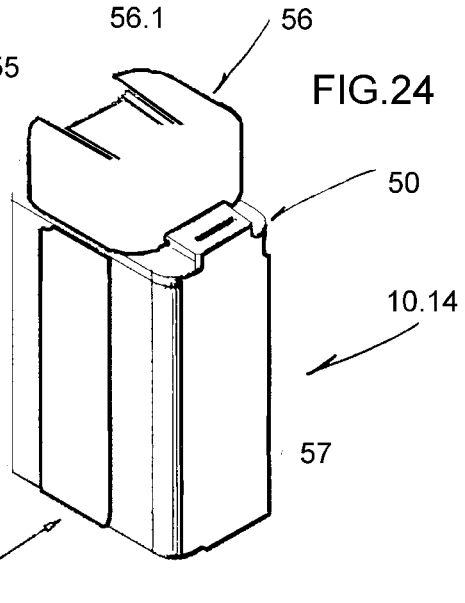
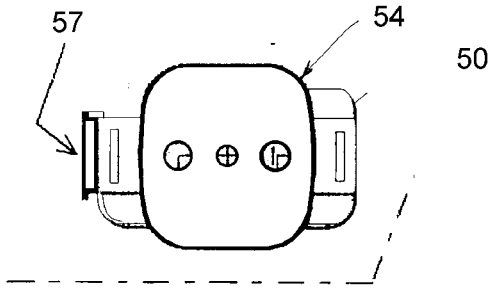
FIG.25

FIG. 28
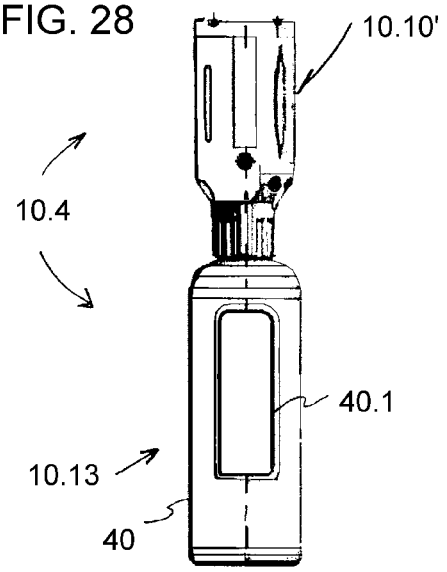
FIG. 29
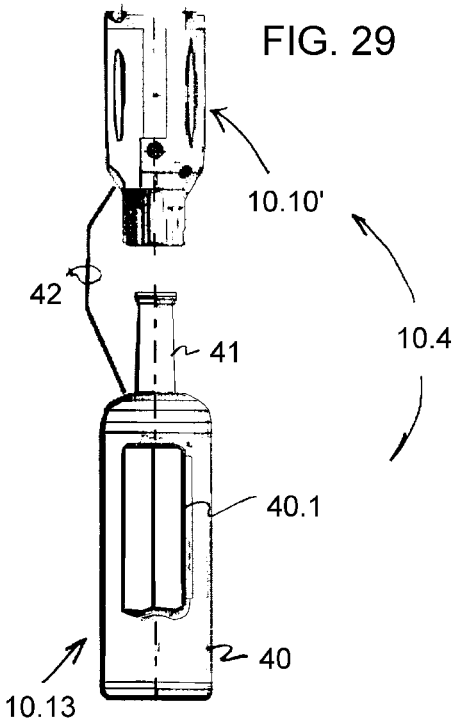
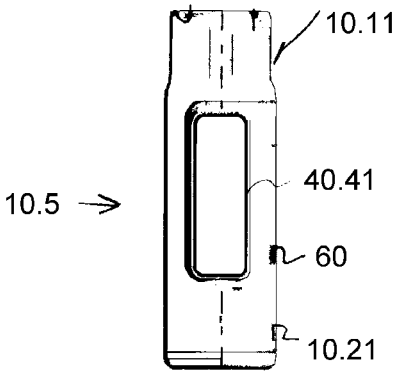
FIG. 30
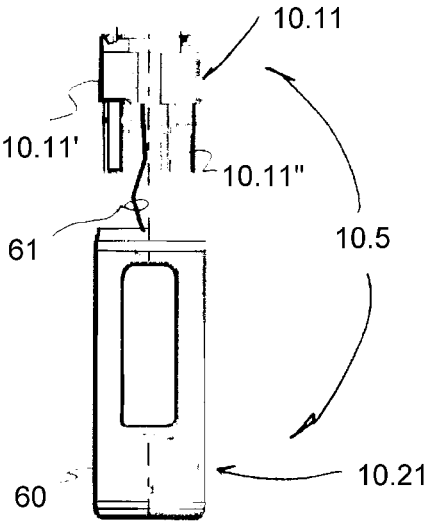
FIG. 31

POINTER ILLUMINATOR DEVICE FOR AUTONOMOUS USE AND WITH A TOY WEAPON

The present invention relates to a pointer illuminator device for autonomous use and with a toy weapon.

A toy weapon, also known as "Air Soft Gun" is a replica, more or less faithful, of a firearm. In general, toy weapons shoot round balls through the thrust imparted by the compression of a gas (air, propane, carbon dioxide). Compressed air weapons are used to practice "Softair".

The publication WO2007012570A1 discloses a lighting device with at least one means for producing incoherent illuminating light and comprising at least one laser marking light.

Moreover, there are known pointer illuminator devices with laser unit for firearm, which can illuminate a target, by means of a coherent light beam, to facilitate adjustment of aim. Generally, said prior art pointer illuminator devices for firearm have relatively important dimension and weight and are fastened on the weapon in an arrangement in which the coherent light beam is substantially not aligned with the desired shooting trajectory. While dimension and weight make the gripped weapon somewhat cumbersome to handle, at the same time the person taking aim is also obliged to perform an optical compensation operation, through the pointing means of the weapon.

Moreover, prior art pointer illuminator devices with laser unit are not provided with simple and effective means for interchangeable use on a toy weapon and on a portable handgrip. Starting from the notion of the aforesaid drawbacks, the present invention intends to provide a remedy.

The invention intends to provide a pointer illuminator device as indicated, with which it is possible to achieve, among others, one or more of the following objects:

- good precision in aiming the weapon;
- easy and safe interchangeability of the device on toy weapon and on portable handgrip;
- reduced dimension and weight, in such a manner as not to limit grip and facilitate handling of the weapon and of the portable handgrip;
- plurality of luminous functions performed selectively by the device as pointer, illuminator and/or luminous indicator, the user being able to select only one or a combination of these functions;
- easy, safe and comfortable use of the same device.

In view of these objects, the present invention provides a pointer illuminator device for autonomous use and with a toy weapon, the essential characteristic of which forms the subject matter of claim 1.

Further advantageous characteristics are described in the dependent claims.

The aforesaid claims are intended as fully incorporated herein. The present invention will be more apparent from the detailed description below, with reference to the accompanying drawing, provided purely by way of non-limiting example, wherein:

FIG. 5 illustrates, in a schematic perspective view, the pointer illuminator device according to FIG. 1 mounted in an autonomous manner with portable handgrip in the form of L-shaped electric torch;

FIGS. 6 to 8 illustrate, in a perspective view, a front view and a side view, respectively, an intermediate body of the electric torch according to FIG. 5;

Figure 1:
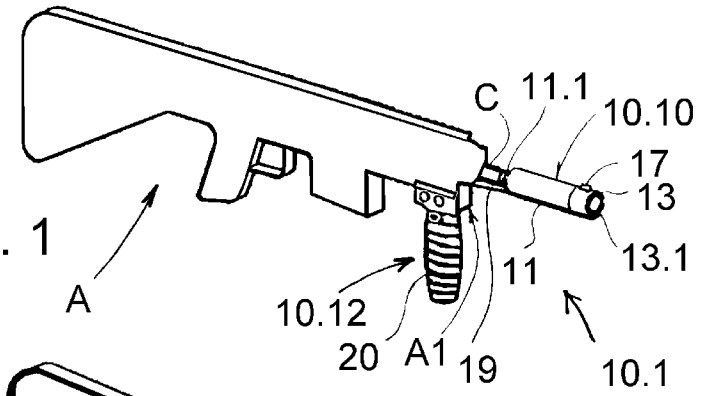
FIGS. 1 to 4 illustrate, in a schematic perspective view, the pointer illuminator device according to different examples of embodiment of the invention, mounted on a toy weapon in the form of a machine gun.
Figure 2:
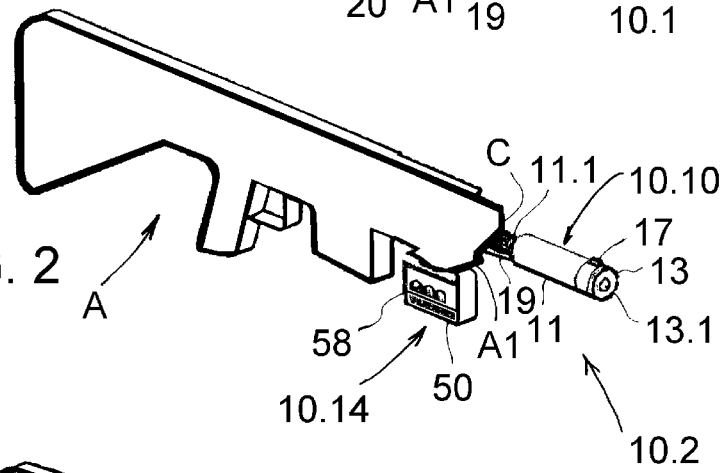
Figure 3:
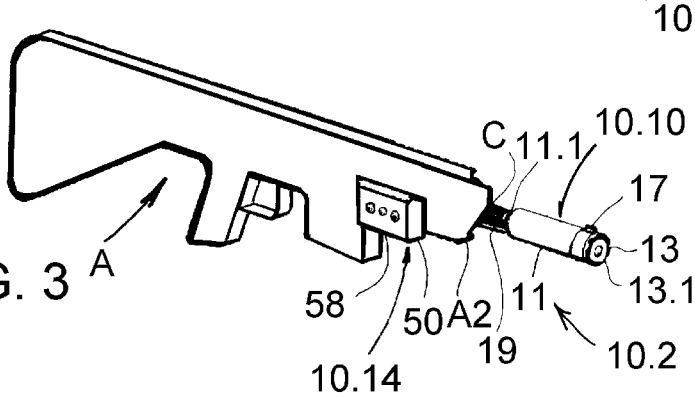
Figure 4:
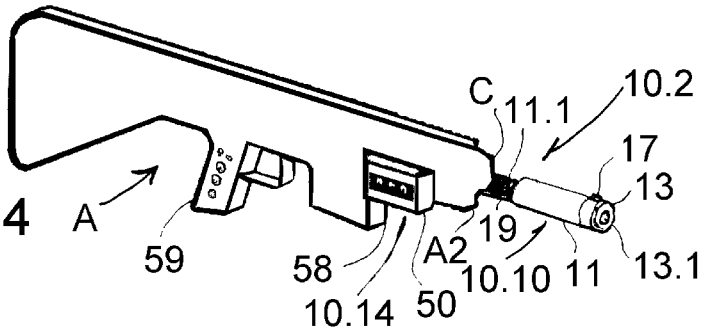
Figure 11:
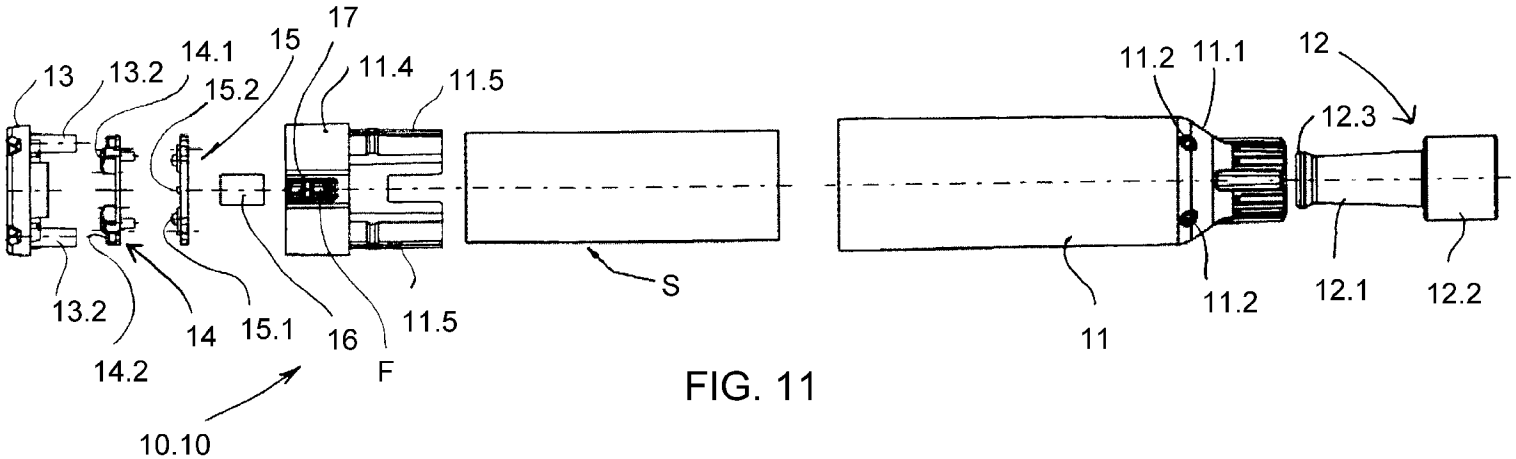
Figure 12:
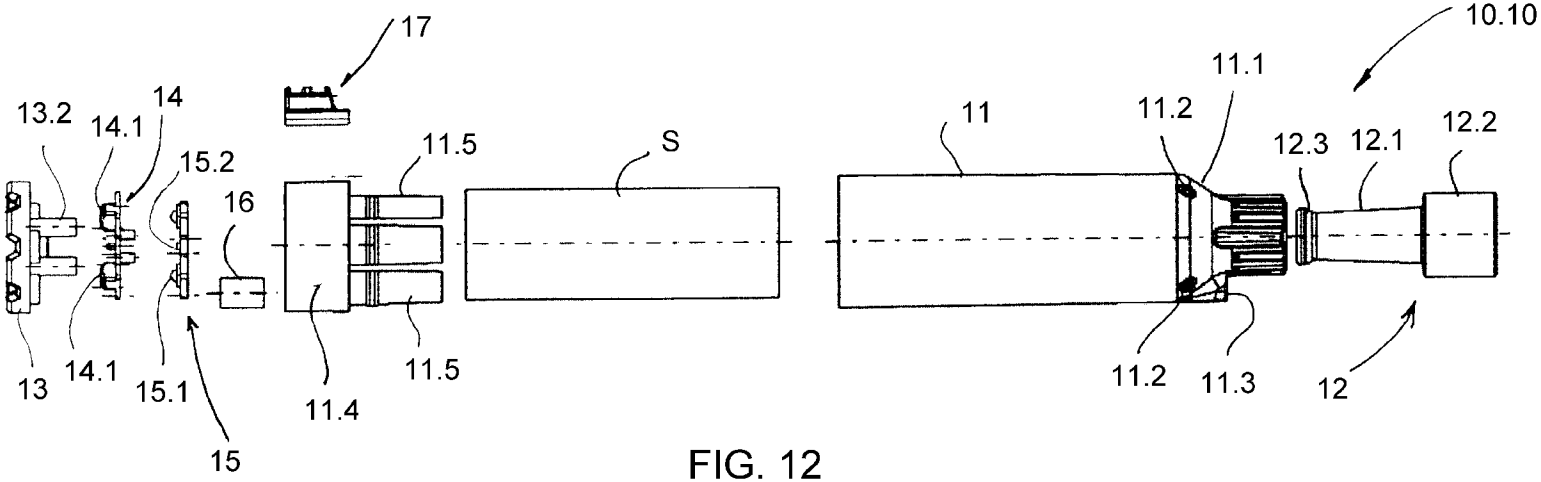
Figure 15:
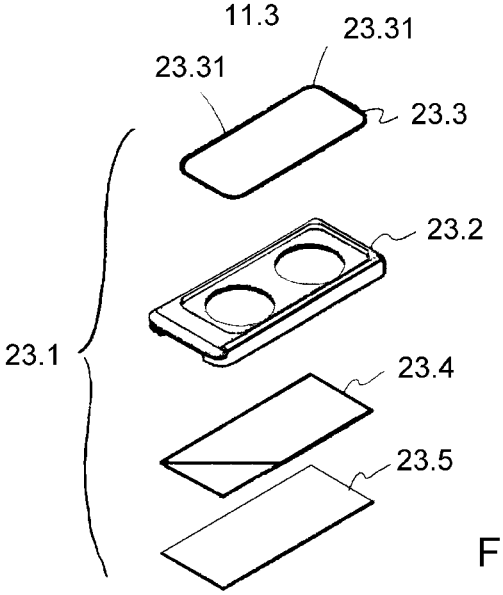
Figure 16:
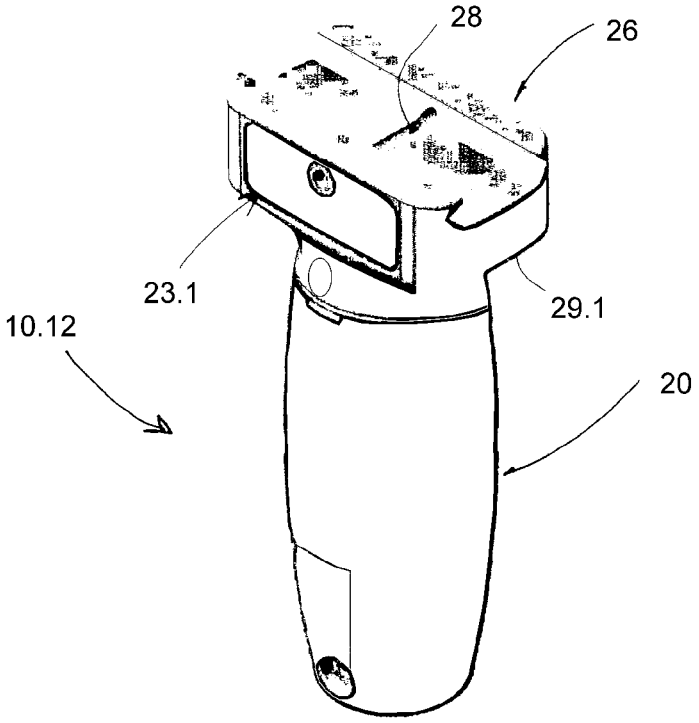
Figure 17:
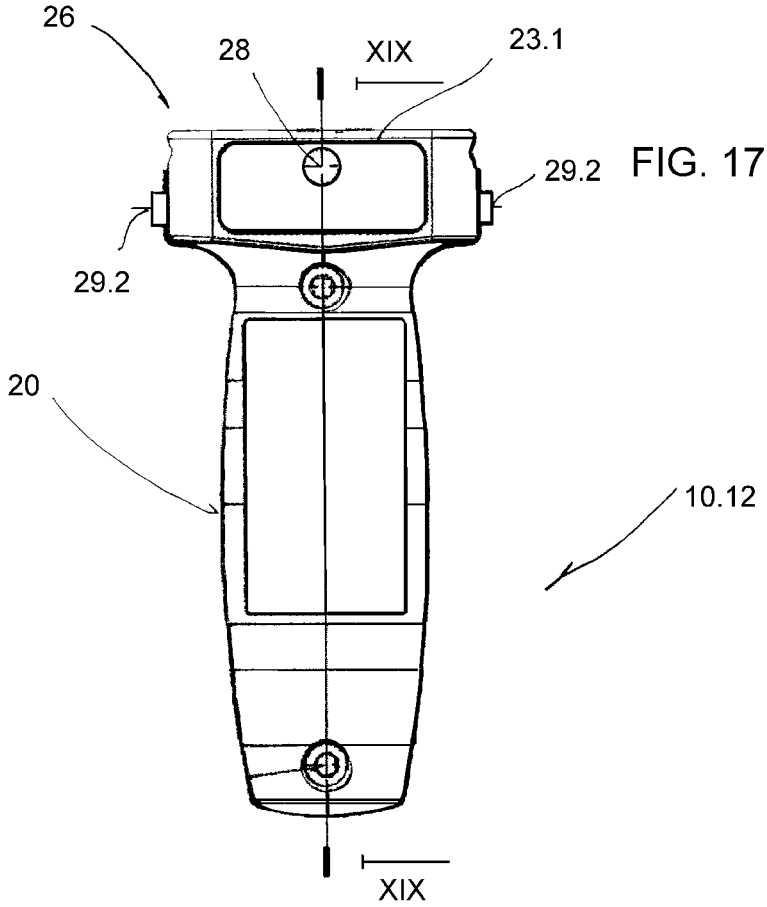
Figure 18:
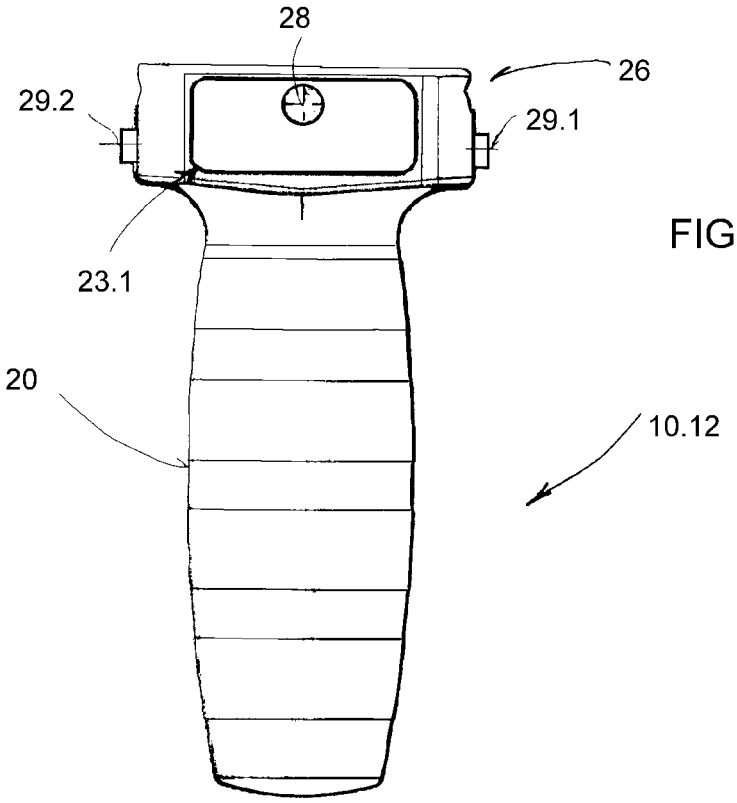
Figure 19:
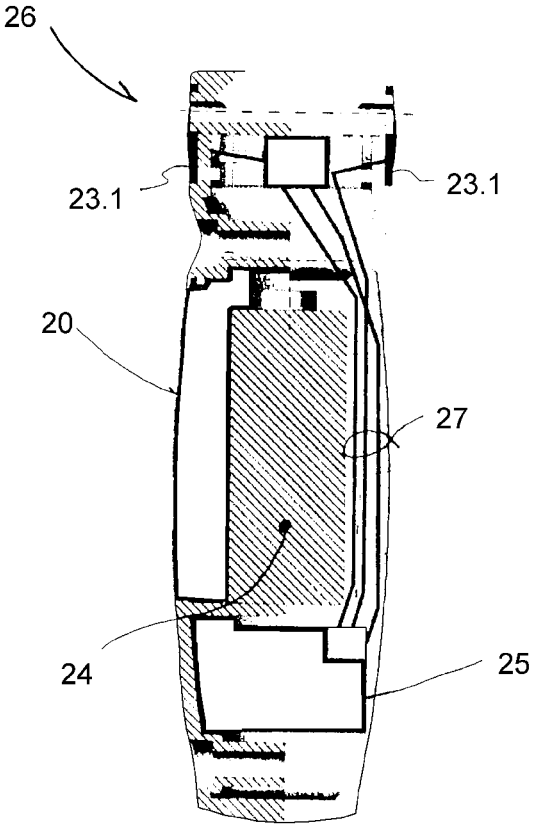
Figure 20:
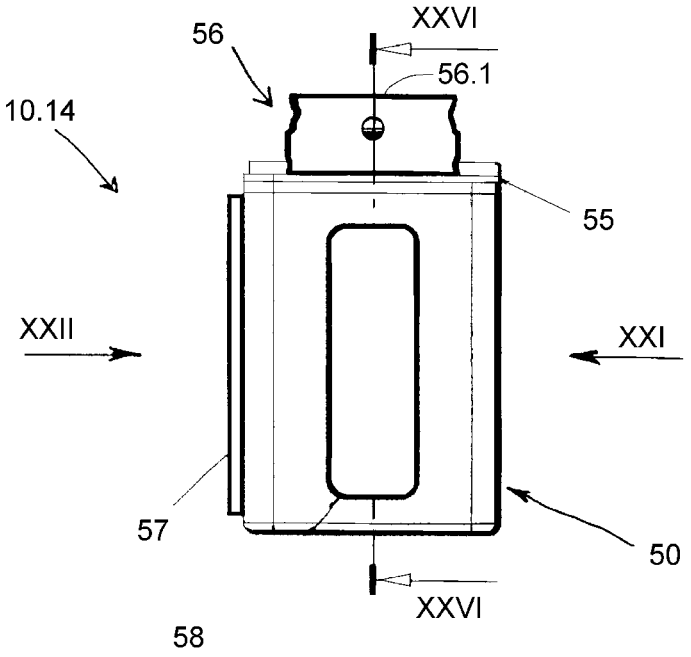
Figure 21:
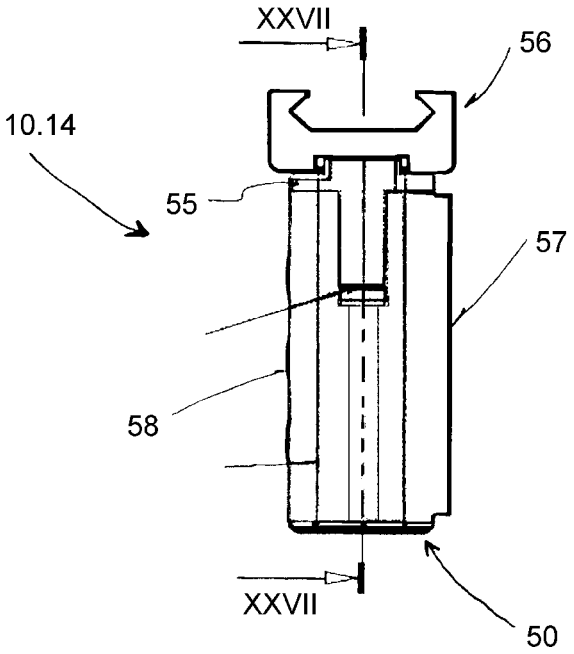
Figure 27:
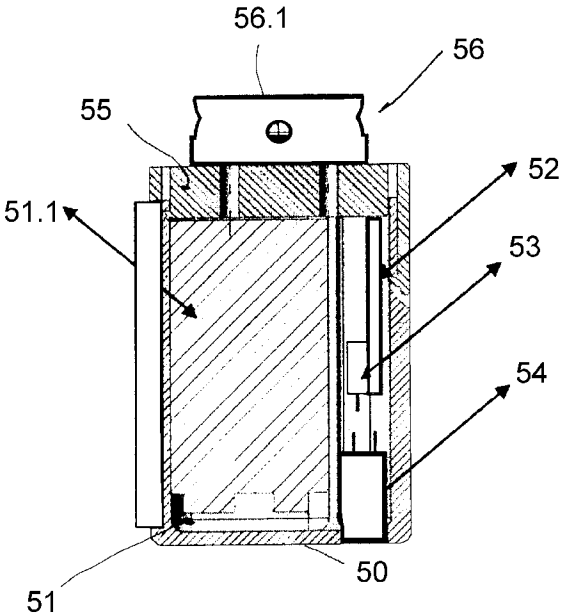
Figure 26:
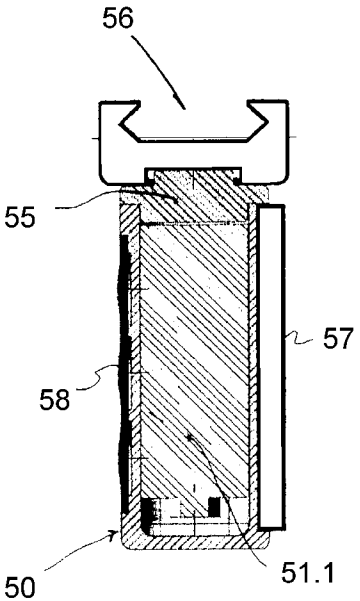

FIGS. 9 and 10 illustrate, respectively, in a perspective view, the pointer illuminator device according to the present invention, mounted in an autonomous manner with handgrip in the form of L-shaped electric torch similar to the device of FIG. 5, but wherein a light emission unit has, respectively, a length reduced approximately to half and to a third of that of the corresponding unit illustrated in said FIG. 5;

FIGS. 11 to 14 show, respectively, in a top plan and exploded view (FIG. 11), in a side elevation and exploded view (FIG. 12), in a front and exploded view (FIG. 13), in a back and exploded view (FIG. 14) a light emission unit of the device according to FIGS. 1 to 5;

FIG. 15 illustrates, in a perspective and exploded view, a push button panel of the device according to FIG. 1;

FIGS. 16 to 19 illustrate, respectively, in a perspective view (FIG. 16), in an elevated front view (FIG. 17), in an elevated back view (FIG. 18), and in a sectional view (FIG. 19) according to the line XIX-XIX of FIG. 17, a control and supply unit of the device according to FIG. 1;

FIGS. 20 to 27 illustrate, respectively, in an elevated front view (FIG. 20), in an elevated side view according to the arrow XXI of FIG. 20 (FIG. 21), in an elevated side view according to the arrow XXII of FIG. 20 (FIG. 22), in a perspective front view (FIG. 23) and back view (FIG. 24), in a top plan view (FIG. 25) and in a section according to the line XXVI-XXVI of FIG. 20 (FIG. 26) and according to the line XXVII-XXVII of FIG. 21 (FIG. 27), a control and supply unit of the device according to FIGS. 2 to 4;

FIGS. 28 and 29 illustrate, in an elevated view (FIG. 28) and in an exploded view (FIG. 29), the pointer illuminator device according to another example of embodiment of the invention, mounted in an autonomous manner with portable handgrip in the form of an electric torch with a substantially cylindrical straight body;

FIGS. 30 and 31 illustrate, in an elevated view (FIG. 30) and in an exploded view (FIG. 31), the pointer illuminator device according to a further example of embodiment of the invention, mounted in an autonomous manner with portable handgrip in the form of an electric torch with a substantially cylindrical straight body.

With reference firstly to FIGS. 1 to 4, the letter A indicates a toy weapon of the machine gun type. The pointer illuminator device according to the invention is mounted in a detachable manner on said toy weapon A and is indicated respectively with 10.1 in FIG. 1 and with 10.2 in FIGS. 2 to 4.

Description of the Device 10.1 of FIG. 1

With reference also to FIGS. 11 to 19, said device 10.1 comprises a light emission unit 10.10, substantially including (FIGS. 11-14):

- a tubular body 11, essentially cylindrical, for example in plastic, connected in a detachable manner and coaxial relative to the barrel C of the weapon A by means of a removable mounting bushing 12; the inner diameter of said tubular body 11 is greater than the caliber of the barrel C;
- a front end collar 11.4, for example in plastic, fastened in a coaxial manner and with elastic snap fastening in said tubular body 11 by means of the integral axial tabs 11.5 and which delimit in said tubular body 11 an axial through hole, aligned with the barrel of the weapon A;
- a front cover 13, for example in plastic, mounted coaxial to close the front end of said collar 11.4 by means of a plurality of integral pins 13.2 engaged in corresponding seats of said collar. Said cover 13 has an axial through hole 13.1, aligned with the barrel of the weapon A and corresponding at least to the caliber of the projectile of the same weapon, while in said cover 13 there are provided four rectangular openings, in a cross-shaped arrangement relative to the axis of the hole 13.1, two slits diametrically opposite relative to the same hole, and a bore with axis coplanar to that of said hole 13.1;

a circular mounting 14, for example in plastic material, coupled inside said cover 13 and containing four lenses 14.1 for illumination LEDs (inserted respectively in said openings of the cover), two lenses 14.2 for indicator LEDs (inserted respectively in said slits of the cover); said mounting 14 being provided with a bore corresponding to that of the cover 13 and with an axial through hole aligned with that of the barrel of the weapon A and of at least corresponding caliber;

a circular printed electronic circuit card 15 for electrical connection and supply, coupled at the back relative to said mounting 14 and on which there are electrically connected four illumination LEDs 15.1, arranged respectively at said lenses 14.1, two indicator LEDs 15.2, arranged respectively at said lenses 14.2. Said printed circuit card has a bore corresponding to that of the cover 13 and of the mounting 14 and an axial through hole aligned with that of the barrel of the weapon A and of at least corresponding caliber;

a laser emission electronic device 16, generically cylindrical in shape housed permanently in part in the bores of said cover 13, mounting 14 and card 15, and in part in a corresponding cavity of said collar 11.4.

Said laser emission device 16 and said supply and control card 15 are electrically connected relative to an electronic control circuit and to an electric supply source, for example with direct current (which will be described below), by means of an insulated electric cable 19 branched from the same and which exits through a corresponding opening 11.3, provided in the tapered back part 11.1 of said tubular body 11.

Moreover, on the external surface of said tubular body 11 there is provided an axial groove, in which there is fastened a sight plate 17.

Moreover, in proximity of said tapered back part 11.1 of said tubular body 11, there are provided, along a same circumference, a plurality of threaded through holes 11.2 in which respective threaded set screws are engaged.

Said mounting bushing 12 has a truncated cone shaped end 12.1, terminating with an outwardly projecting circumferential lip 12.3, while the opposite end with cylindrical body 12.2, axially hollow and threaded internally, is provided for detachable fastening relative to the barrel C of the weapon A. The conically tapered end 12.3 is inserted axially into the tapered back end 11.1 of the tubular body 11 and the set screws engaged in the through holes 11.2 are juxtaposed with force with one end thereof against the lip 12.3 of the same bushing, in such a manner as to produce fastening and allow axial adjustment of said tubular body 11 and of the related through hole 13.1 relative to the barrel C of the toy weapon.

In the tubular body 11, between the front collar 11.4 and the tapered back end 11.1 there is contained a tubular bearing S in spongy synthetic material, with the function of silencer. Said bearing S has an axial through hole aligned with that of the barrel C of the weapon A and having a larger caliber to that of the projectile of the same weapon.

With reference both to FIG. 1 and to FIGS. 16 to 19, said device 10.1 also comprises a control and supply unit 10.12, structurally separate from said light emission unit 10.10 and essentially including a casing 20, forming a substantially small barrel-shaped handgrip, for example in plastic material, which comprises a compartment with an electric battery 24, a compartment with an electronic printed circuit for supply and control 25 and compartments with corresponding internal cables for electric/electronic connection 27.

The top part 26 of the casing 20 is configured as female dovetail prismatic guide and has a through hole with transverse axis 28 threaded at the ends, in which corresponding threaded set screws are engaged.

Said prismatic guide top part 26 of the casing 20 is coupled with a corresponding male dovetail prismatic part A1 of the weapon A, underneath the barrel and to which said unit 10.12 is detachably fastened by means of said set screws. In this manner, said casing 20 forms a solid supplementary handgrip of the weapon A.

In the front and rear areas of said top part 26 of the casing 20 there are provided respective terminal electric connectors 29.1, 29.2, relative to which there are electrically branched respective insulated electric cables 27 for connection to said electronic printed circuit 25 and said electric battery 24.

On the two external lateral faces of said top part 26 of the casing 20 there are fastened respective removable push button operating panels 23.1, relative to which there are electrically branched respective insulated electric cables 27 for connection to said electronic printed circuit 25 and to said electric battery 24. Said push button panels 23.1 each comprise two operating buttons. Said push button panels 23.1 are fastened, in a detachable manner, by means of Velcro"®, type connection tapes, as explained below.

In particular and with reference also to FIG. 15, said push button panel 23.1 comprises a mounting frame 23.2, for example in plastic material, essentially rectangular and supporting therein a push button panel with electronic integrated circuit card 23.3, the buttons 23.31 of which are exposed on the front face of the push button panel 23.1. On the back face of said push button panel 23.1 there is fastened a part 23.4 of a Velcro tape connection means, the other part 23.5 of which is fastened relative to the casing 20 (for example by means of glue), in such a manner as to allow detachable connection of said push button panel 23.1. Each electric cable 27 for connection of said push button panel 23.1 relative to said electronic printed circuit 25 and to said electric battery 24 passes through a corresponding opening in the top part 26 of the casing 20.

Moreover, the insulated electric supply and control cable 19 exiting from the opening 11.3 of the light emission unit 10.10 is electrically branched and fastened, for example, to the front connector 29.1 of the casing 20 of the control and supply unit 10.12 of the device 10.1.

During use of the toy weapon A, the user grips the casing 20 like a handgrip to improve stability of the weapon and using comfort and, by means of the push button panels 23.1 located on the sides of the casing 20, selectively controls the functions of the pointer illuminator device 10.1 according to the invention, as will be more apparent below.

Description of the Device 10.2 of FIGS. 2, 3, 4

Reference is also made here to FIGS. 20 to 27. Said device 10.2 comprises a light emission unit 10.10 similar in all respects to the one described above with reference to the device 10.1 and therefore further description of which is therefore omitted. Said device 10.2 also comprises a control and supply unit, indicated here with 10.14.

Said control and supply unit 10.14 essentially comprises (FIGS. 20-27):

a box-shaped casing 50, for example in plastic and having two cavities inside: a larger cavity 51, which contains an electric battery 51.1, for example a 9 volt direct current battery, and a smaller cavity 52, which houses an electronic printed circuit card 53 electrically connected to an insulated electrical terminal block 54, provided at the bottom of the casing.

Said box-shaped casing 50 is closed at the top by a removable cover 55, on which a female dovetail prismatic guide coupling 56 is detachable fastened. Said coupling 56 has opposite through holes 56.1, with transverse axis, threaded and in which corresponding threaded set screws are engaged.

As shown in FIG. 2, said prismatic guide coupling 56 of the casing 50 is coupled with a corresponding male dovetail prismatic part A1 of the weapon A, underneath the barrel, and is detachably fastened by means of said set screws.

Said casing 50 also supports, on two external lateral faces thereof, respective further male dovetail prismatic guide couplings 57.

As illustrated in FIGS. 3 and 4, one of said dovetail couplings 57 of the casing 50 is coupled with a corresponding female dovetail prismatic part A2 of the weapon A, lateral relative to the barrel, and is thus detachably fastened to the same weapon.

On the other external lateral face, said casing 50 supports a removable push button operating panel 58 with three buttons, but for the remaining part it is similar in all respects to the push button panel 23.1 of the device 10.1 described above.

From said push button panel 58 an insulated electrical conductor cable (not visible in the drawings) is branched to said control card 53 housed in the cavity 52 of the casing 50. The insulated electrical cable exiting from the opening 11.3 of the emission unit 10.10 is connected to the terminal block 54.

In FIG. 4, there is illustrated a further push button panel 59, with structure and connections similar in all respects to the push button panel 58 described above, but which is fastened in a detachable manner on the weapon A in proximity of the trigger.

Description of the Device 10.3 According to FIGS. 5 to 8

With reference firstly to FIG. 5, the number 10.3 indicates as a whole the pointer illuminator device according to this variant of embodiment of the invention. Said device 10.3 comprises the same light emission unit 10.10, described above with reference to the device 10.1 according to the invention, mounted in a detachable manner relative to the control and supply unit 10.12, also already described with reference to the device 10.1 and here constituting a portable handgrip, with the intermediation of a coupling means 30.

Said coupling means 30 comprises an essentially parallelepiped shaped body 31, for example in plastic material, including, in an integral body:

- projecting from a major face thereof, a male dovetail prismatic projection 31.1, coupled detachably with the top part 26 of the casing 20, configured as female dovetail prismatic guide (the connection is made stable by means of tightening the set screws in the holes 28 of said part 26);
- projecting from a minor face thereof, orthogonal to the face containing said projection 31.1, an integral shank 31.2, which is configured as the mounting bushing 12 of said device 10.1.

In particular, said shank 31.2 has a truncated cone shaped end 31.3, terminating with an outwardly projecting circumferential lip 31.4 and axially inserted in the tapered back end 11.1 of the tubular body 11. The connection is stabilized by means of the set screws engaged in the holes 11.2 of the tubular body 11.

The electrical connection of the control and supply unit 10.12 relative to the light emission unit 10.10 is produced as described above by means of an insulated electric cable.

The two units 10.10 and 10.12 thus connected to each other form a substantially L-shaped autonomous portable electric torch device.

Variant According to FIGS. 9 and 10

In said figures the device according to the invention is respectively indicated with 10.3' and with 10.3".

These are variants of the device 10.3 described above with reference to FIG. 5, in which the only difference (dimensional and not structural) relates to the light emission unit.

In the device 10.3' said emission unit is indicated with 10.10' and has a length substantially equal to approximately half that of the corresponding unit 10.10 of the device 10.3.

In the device 10.3" said emission unit is indicated with 10.10" and has a length substantially equal to approximately a third of that of the corresponding unit 10.10 of the device 10.3.

The remaining part of the structure of the aforesaid devices 10.3' and 10.3" is similar in all respects to that of the device 10.3, the description of which should be referred to.

Description of the Device 10.4 According to FIGS. 28, 29

The number 10.4 indicates as a whole the pointer illuminator device according to the invention. Said device 10.4 comprises the light emission unit 10.10', described with reference to the device 10.3' according to the invention, mounted in a detachable manner on a control and supply unit 10.13 also constituting a portable handgrip, so as to form an autonomous entity.

Said control and supply unit 10.13 essentially comprises:

- a substantially cylindrical casing 40, for example in plastic material, comprising the same components as the control and supply unit 10.12, described with reference to the device 10.1 according to the invention, and which is provided externally with a push button panel 40.1 analogous, in structure and function, to the push button panel 58 of the control and supply unit 10.14 described above;
- an integral shank 41 connection part, which is configured as the mounting bushing 12 of said device 10.1.

Said control and supply unit 10.13 is connected relative to the light emission unit 10.10 as described above with reference for example to the device according to FIG. 5. An insulated electric cable 42 functionally connects the two units 10.10' and 10.13, which thus form a portable autonomous electric torch device with a substantially cylindrical straight body.

For the remaining part reference should be made to the description provided above of the aforesaid parts and of their electrical connections.

Description of the Device 10.5 According to FIGS. 30, 31

Said device 10.5 comprises a light emission unit 10.11, mounted in a detachable manner on a control and supply unit 10.21 also constituting a portable handgrip, so as to form an autonomous entity.

Said light emission unit 10.11 is a miniaturized version of the light emission unit 10.10 described above with reference to the device 10.1.

In particular, said unit 10.11 comprises a substantially cylindrical tubular head part 10.11', for example in plastic material, and a plurality of peripheral longitudinal engaging tabs 10.11" projecting axially from one end of said head. In the head 10.11' there are provided electric circuit means (connection and supply electronic printed circuit card) and the LEDs for emission of incoherent light for illumination and indication and of laser marking light, as in said light emission unit 10.10. Moreover, said control and supply unit 10.21 comprises a substantially cylindrical casing 60, for example in plastic material, similar in all respects to the casing 20 of said device 10.1 and which comprises (as described with reference to the control and supply unit 10.12 of the device 10.1) a housing with an electric battery, a housing with an electronic printed circuit for supply and control and housings with corresponding internal isolated electric cables for electric/electronic connection.

An isolated electric cable 61 provides the electrical connection between the electric/electronic components of said light emission unit 10.11 and said control and supply unit 10.21, units which thus form a portable autonomous electric torch device with a substantially cylindrical straight body.

Operation of the Device According to the Invention.

Firstly, it can be noted that as described above and illustrated, the light emission unit has a through hole with a diameter corresponding at least to the caliber of the barrel of the toy weapon, on which the same unit is mounted, and which extends the hole of this barrel axially.

Moreover, as described above and as can be seen in particular from FIG. 13, the light emission unit comprises:

four lighting LEDs 15.1 (corresponding to the lenses 14.1) of the mounting 14, and two indicator LEDs 15.2 (corresponding to the lenses 14.2) of the mounting 14, which are arranged radially in proximity of the axis of the barrel C of the weapon A and, therefore, in close proximity of the exit hole of the projectile from the device according to the invention.

During simulation of combat, the aforesaid LEDs are selectively switched on/off (energized or de-energized), individually or in combination with one another, acting on the push button panel (or on the push button panels) for electric control of the device according to the invention.

The lighting LEDs, for example with white light, have the function of illuminating and at the same time dazzling the person who is under aim or in front of the weapon.

The indicator LEDs, for example with red light, are used in the game "softair" to indicate to the other players that a person has been (virtually) hit and is out of the game. For example, it is possible to set (by means of the control and supply electronic card means) a delay, during which the indicator lights remain switched on and after which they are switched off, allowing the player to return to the game.

The coherent light generator-emitter or laser marking means is arranged, preferably, immediately below the exit hole of the projectile from the device according to the invention, with its optical axis substantially coplanar (in the vertical plane) with the axis of the barrel during pointing of the same weapon. In fact, the exploded projectile travels, through gravity, along a trajectory with downward inclination. The aforesaid arrangement of the laser light generator-emitter allows more precise collimation of aim to be obtained, as a function of the distance travelled by the projectile fired from the weapon.

The Sight of the Device According to the Invention

With reference to FIGS. 1 and 11 to 14, the number 17 indicates a sight plate connected relative to the front collar 11.4 of the light emission unit 10.10.

In particular, said sight plate 17 is configured in the fashion of a slide coupled in a corresponding longitudinal groove of said collar 11.4 and is fastened in a detachable manner relative to the same groove.

Figure 13:
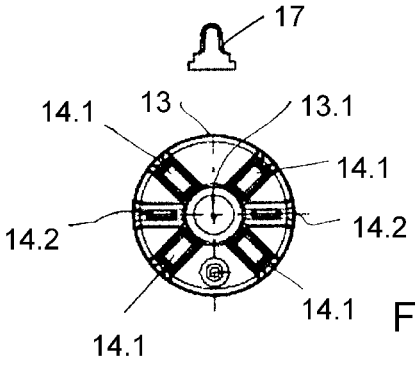
Figure 14:
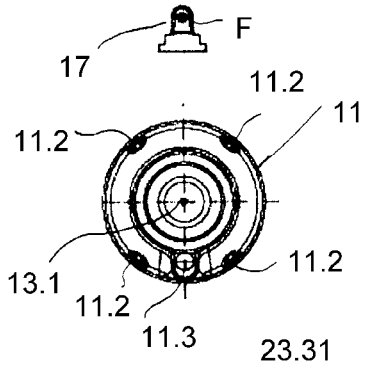

In said sight plate 17 there is housed a length of optical fiber F (or optical fiber bundle F) with axis substantially parallel to that of the barrel C of the weapon and with a free end facing toward the person pointing the same weapon, while the other end of said optical fiber F is blind, i.e. not visible by the person against which the weapon is pointed (see in particular FIGS. 13—blind end—and 14—free end of the optical fiber F). A part of the lateral surface of said length of optical fiber (or optical fiber bundle) F is exposed to the ambient light. By means of this arrangement, the length of optical fiber or optical fiber bundle F is illuminated providing a luminous reference point for the person pointing the toy weapon, facilitating the aiming operation.

Moreover, on the electronic printed circuit card 15, coupled at the back relative to the mounting 14, a further LED is electrically connected, for example with red light, which illuminates said length of optical fiber or optical fiber bundle F when energized by means of the push button panel 23.1. In this manner, an intense luminous point "materializes", for example with red light, as a reference for the person aiming the weapon and which facilitates the aiming operation.

The aforesaid sight 17 with "luminous effect" can be used alternatively to the laser marker 16, which while on the one hand allows the luminous aiming point to be placed directly on the target to hit, on the other it exposes the coherent light ray emitted to the opponent's view, in particular in the presence of fog, smoke and/or dust.

The invention claimed is:

1. A pointer illuminator device (10.1, 10.2, 10.3, 10.3', 10.3", 10.4, 10.5) for autonomous use and with a toy weapon (A), comprising at least one LED (14.1, 14.2, 15, 15.1, 15.2) for producing an incoherent light for illumination and at least one laser unit (16) for producing a laser marking light, characterized in that the pointer illuminator device comprises:

a light emission unit (10.10, 10.10', 10.10", 10.11) including: in a casing (11, 11.1, 11.4, 13, 10.11') having a back part (11.1), a through hole (13.1) with a diameter corresponding at least to a caliber of a barrel (C) of the toy weapon (A), on which the same light emission unit is detachably mounted via the back part to a mounting bushing, and which the through hole (13.1) extends from the barrel axially therein and forms an exit hole for a projectile to be expelled from said toy weapon, at least one lighting LED (14.1, 15, 15.1), at least one indicator LED (14.2, 15, 15.2) and a coherent light generator-emitter or laser marker (16), arranged around said exit hole (13.1) of the projectile, in proximity of an axis of the barrel (C) of the toy weapon when the light emission unit is attached to the toy weapon;

a control and supply unit (10.12, 10.14, 10.13, 10.21) which includes: in a casing (20, 50, 40, 60) having a top part (26), an electric battery supply (24, 51.1), an electronic printed circuit control (25, 53), a push button (23.1, 58, 40.1), connected to one another via an electric circuit, wherein the control and supply unit is detachably mounted on the toy weapon via the top part of the casing to a part (A1) of the toy weapon (A), which is different from the mounting bushing; and electric circuit connections (19, 29.1, 29.2, 42, 54, 61) for said battery supply (24, 54.1), circuit control (25, 53) and push button (23.1, 58, 40.1) of the control and supply unit (10.12, 10.14, 10.13, 10.21) relative to said lighting LED (15, 15.1), indicator LED (15, 15.2) and coherent light emission or laser marker unit (16) of the light emission unit (10.10, 10.10', 10.10", 10.11); and in that said illuminator device also comprises:

a first (12) detachable mechanical connection of said casing (11, 11.1, 11.4, 13,') of said light emission unit (10.10) relative to said toy weapon (A) is formed by engagement of said back part to said mounting bushing;

a second (26, 28, 56, 56.1, 57) detachable mechanical connection of said casing (20, 50) of said control and supply unit (10.12, 10.14) relative to said toy weapon (A) is formed by engagement of said top part to said part (A1) of the toy weapon (A), and a third (30, 26, 28, 41, 10.11") detachable mechanical connection of said casing (11, 11.1, 11.4, 13, 10.11') of said light emission unit (10.10, 10.10', 10.10", 10.11) relative to said casing (20, 50, 40, 60) of said control and supply unit (10.12, 10.14, 10.13, 10.21) is formed by engagement of said top part (26) to said back part (11.1), either directly or via an intermediate coupling (30), in such a manner that said illuminator device (10.1, 10.2, 10.3, 10.3', 10.3", 10.4, 10.5) can be used selectively in combination with said toy weapon (A) and as an autonomous and portable entity with a handgrip, for pointing of the toy weapon, for lighting and/or as an indicator light.

2. The pointer illuminator device according to claim 1, characterized in that during pointing of the toy weapon, said coherent light generator-emitter or laser marker (16) is arranged immediately underneath said exit hole (13.1), with an optical axis thereof substantially vertically coplanar with the axis of the barrel (C) of the toy weapon.

3. The pointer illuminator device according to claim 1, characterized in that said pointer illuminator device comprises a plurality of lighting LEDs (14.1, 15, 15.1) and a plurality of indicator LEDs (14.2, 15, 15.2), which are arranged radially in proximity of the axis of the barrel (C) of the toy weapon (A) and in proximity of said exit hole (13.1).

4. The pointer illuminator device according to claim 1, characterized in that the light emission unit comprises a sight plate (17), in which there is a length of optical fiber (F) or an optical fiber bundle (F) housed with an axis substantially parallel to that of the barrel (C) of said toy weapon (A) and with a free end facing toward a person pointing the toy weapon, while another end is blind, where the other end not visible by a person against which the toy weapon is pointed towards, and with a part of a lateral surface of said length of optical fiber (F) or optical fiber bundle (F) exposed to ambient light, in such a manner that said length of optical fiber (F) or optical fiber bundle (F) is illuminated providing a luminous reference point for the person pointing the toy weapon, facilitating aiming operation.

5. The pointer illuminator device according to claim 4, characterized in that the pointer illuminator device comprises LED lighting of said length of optical fiber (F) or of optical fiber bundle (F), in such a manner as to provide a luminous reference point for the person pointing the toy weapon.

6. The pointer illuminator device according to claim 1, characterized in that said first detachable mechanical connection (12) comprises the mounting bushing (12) having a truncated-cone shaped end (12.1), terminating with an outwardly projecting lip (12.3), and an opposite end with a cylindrical body (12.2), which is axially hollow and threaded internally, for detachable fastening relative to the barrel (C) of the toy weapon (A), and in that said truncated-cone shaped end (12.1) is inserted axially into the back part (11.1) of said casing (11) of the light emission unit and set screws, engaged in corresponding threaded through holes (11.2) of said casing of the light emission unit, producing fastening and allowing axial adjustment of said casing (11) of the light emission unit and related through hole (13.1) relative to the barrel (C) of the toy weapon (A).

7. The pointer illuminator device according to claim 6, characterized in that said top part (26) of supply unit is configured as a female dovetail prismatic guide (26, 56, 57) and has at least one through hole with a transverse axis (28, 56.1) that is threaded at the ends, in which corresponding threaded set screws are engaged.

8. The pointer illuminator device according to claim 7, characterized in that said third detachable mechanical connection is formed via a coupling (30) having a male dovetail prismatic projection (31.1), coupled detachably with said female dovetail prismatic guide at the top part (26) of the casing (20) of said control and supply unit (10.12), and a shank (31.2) having a truncated cone shaped end (31.3), terminating with an outwardly projecting lip (31.4), inserted axially into a part of rear end (11.1) of said casing (11) and fastened by set screws engaged in holes (11.2) of said casing (11) and which allow axial adjustment of said casing (11) and related through hole relative to the barrel (C) of the toy weapon (A), and in that said light emission unit (10.10, 10.10', 10.10") and said control and supply unit (10.12) thus connected form a substantially L-shaped autonomous portable electric torch device.

9. The pointer illuminator device according to claim 1, characterized in that said third detachable mechanical connection (41, 10.11") connects said casing (10.11') of said light emission unit (10.10', 10.11) and said casing (40, 60) of said control and supply unit (10.13, 10.21) by a reciprocal axial connection, and in that said light emission unit (10.10', 10.11) and said control and supply unit (10.13, 10.21) thus connected to form a portable autonomous electric torch device with a substantially cylindrical straight body.

10. The pointer illuminator device according to claim 1, characterized in that said push button (23.1, 58, 40.1) comprises a mounting frame (23.2), supporting a push button panel with electronic integrated circuit card (23.3) therein, the push button panel having buttons (23.31) which are exposed on a front face, while on a back face there is a first part (23.4) of a hook and loop fastener and a second part (23.5) of said hook and loop fastener fastened relative to the casing (20, 50, 40, 60) of said control and supply unit (10.12, 10.14, 10.13, 10.21), in such a manner as to allow detachable connection of the same push button panel.

11. The device of claim 1, wherein the casing of the control and supply unit forms a solid supplementary handgrip of the toy weapon A.

12. A pointer illuminator device for autonomous use and with a toy weapon, comprising at least one incoherent light for illumination and at least one laser unit for producing a laser marking light, said pointer illuminator device further comprising:

a light emission unit including: in a casing, a through hole with a diameter corresponding to a caliber of a barrel of the toy weapon, on which the same light emission unit is mounted via a back part of the casing to a mounting bushing, and which extends from the barrel axially and forms an exit hole for a projectile to be expelled from said toy weapon, at least one LED light, at least one LED indicator and a coherent light generator-emitter or laser marker, arranged around said exit hole of the projectile in proximity of an axis of the barrel of the toy weapon when the light emission unit is attached to the toy weapon;

a control and supply unit which includes: in a casing, an electric battery supply, an electronic printed circuit controller, a push button, connected to one another via an electric circuit, wherein the control and supply unit is detachably mounted on the toy weapon via a top part of the casing to a part underneath the barrel of the toy weapon;

and an electric circuit connection of said supply, controller and push button of the control and supply unit relative to said LED light, indicator and coherent light emission or laser marker of the light emission unit; and said device further comprises:

a first detachable mechanical connection of said casing of said light emission unit relative to said toy weapon is formed by engagement of said back part and said mounting bushing;

a second detachable mechanical connection of said casing of said control and supply unit relative to said toy weapon is formed by engagement of said top part and said part underneath the barrel of the toy weapon, and a third detachable mechanical connection of said casing of said light emission unit relative to said casing of said control and supply unit is formed by engagement of said top part and said back part, optionally via an intermediate coupling, in such a manner that said same device can be used selectively in combination with said toy weapon and as an autonomous and portable entity with handgrip, for pointing of the same toy weapon, for lighting and/or as indicator light.

* * * * *